United States Patent [19]

Cosco et al.

[11] 4,004,189

[45] Jan. 18, 1977

[54] THREE-ELECTRODE SHORT DURATION FLASH TUBE

[75] Inventors: Robert J. Cosco, Amesbury; John A. Pappas, Winthrop; Thomas A. Brewin, Hamilton, all of Mass.

[73] Assignee: GTE Sylvania Incorporated, Salem, Mass.

[22] Filed: June 7, 1976

[21] Appl. No.: 693,580

Related U.S. Application Data

[63] Continuation of Ser. No. 528,826, Dec. 2, 1974, abandoned.

[52] U.S. Cl. ..... 315/335; 313/192; 313/198; 313/201; 313/224; 313/220

[51] Int. Cl.[2] ..... H01J 61/06; H01J 61/16; H01J 61/30; H05B 41/30

[58] Field of Search ..... 313/201, 224, 220, 345, 313/515, 192, 198; 315/335

[56] References Cited

UNITED STATES PATENTS

| | | | |
|---|---|---|---|
| 2,018,874 | 10/1935 | Reitherman et al. | 313/515 X |
| 2,102,189 | 12/1937 | Barclay | 313/220 X |
| 2,102,190 | 12/1937 | Barclay | 313/220 X |
| 2,121,333 | 6/1938 | Barclay | 313/190 |
| 3,047,763 | 7/1962 | Inman | 313/220 X |
| 3,105,917 | 10/1963 | van den Broek | 313/224 X |
| 3,179,897 | 4/1965 | Edgerton | 313/201 X |
| 3,840,766 | 10/1974 | Pappas et al. | 313/220 X |
| 3,855,495 | 12/1974 | Pappas et al. | 313/220 X |
| 3,875,475 | 4/1975 | Townsend | 313/515 X |

OTHER PUBLICATIONS

"Amglo Flashtube Eng. Manual," pp. 2, 3, 6, 10, Index Page.

*Primary Examiner*—Palmer C. Demeo
*Attorney, Agent, or Firm*—Edward J. Coleman

[57] ABSTRACT

A flash tube having an elongated tubular envelope containing a pair of anode electrodes disposed at opposite ends and a centrally located cathode electrode which is common to both anodes for simultaneously defining two separate arc discharge paths during operation. The three-electrode configuration is particularly useful in photograhic and photocopying applications for minimizing dark spots and providing a shorter flash duration.

17 Claims, 2 Drawing Figures

THREE-ELECTRODE SHORT DURATION FLASH TUBE

This is a continuation of application Ser. No. 528,826 filed Dec. 2, 1974, and now abandoned.

BACKGROUND OF THE INVENTION

This invention relates generally to electric discharge lamps and, more particularly, to flash tubes of the type useful for photographic and photocopying applications.

Flash tubes generally comprise two spaced apart electrodes within an hermetically sealed glass envelope having a rare gas fill, typically xenon, at a subatmospheric pressure. Such lamps are connected across a large capacitor charged to a substantial potential, which is, however, insufficient to ionize the xenon gas fill. Upon application of an additional pulse of sufficient voltage, the xenon is ionized and an electric arc is formed between the two electrodes, discharging the large capacitor through the flash tube, which emits a burst of intense light. In many cases the pulse voltage is applied between an external trigger wire wrapped around the envelope and the electrodes; this is referred to as shunt triggering. However, in other cases an external wire is not feasible since it may result in an undesirable arcing between the trigger wire and a proximate lamp reflector or else the high potential applied to the external trigger wire might be hazardous to operating personnel. In those cases, the lamp may be internally triggered by applying the pulse voltage directly across the lamp electrodes, a technique referred to as injection triggering. Usually the voltage required is about 30 to 50 percent higher than that required to trigger the same lamp with external trigger wire.

In reprographic applications wherein a very uniform light pattern over a relatively large area is desired, shunt-triggered flash tubes having a very elongated envelope have been employed. For example, the envelope may have a somewhat circular configuration with the electrodes disposed at the closed ends of the envelope. Such an arrangement poses a disadvantage in that the long arc discharge path results in a flash duration which is longer than desired for phtographic and photocopying applications. To shorten the flash duration, the use of two semicircular flash tubes has been proposed; however, this increases the amount of dark space which appears at the ends of the tubes where the electrodes are disposed and, thus, detracts from the desired uniformity of illumination.

Photocopy machines have also employed shunt-triggered flash tubes to provide a light source arranged in a somewhat rectangular configuration. More specifically, a pair of U-shaped flash tubes may be employed to form the rectangle, or to provide a shorter flash duration, a system of four L-shaped flash tubes can be connected in parallel. Such an arrangement, however, increases the problem of dark spaces in the light source in the areas where the electrode connections are provided, with a resulting non-uniform illumination in the photocopy application.

SUMMARY OF THE INVENTION

Accordingly, it is an object of the present invention to provide an improved flash tube, particularly for photographic and photocopying applications.

It is a particular object to provide a short duration flash tube for providing a relatively broad area of illumination in which dark spots are minimized.

These and other objects, advantages and features are attained, in accordance with the principles of the invention, by providing a flash tube having an elongated tubular body with a pair of anode electrodes disposed at the ends and a cathode electrode disposed between the anodes for simultaneously defining two separate discharge paths during operation. Where a balanced light output is desired, the envelope configuration and electrode locations are selected to provide substantially equal impedances for the two discharge paths.

BRIEF DESCRIPTION OF THE DRAWING

This invention will be more fully described hereinafter in conjunction with the accompanying drawings, in which.

DESCRIPTION OF PREFERRED EMBODIMENT

Figure 1:
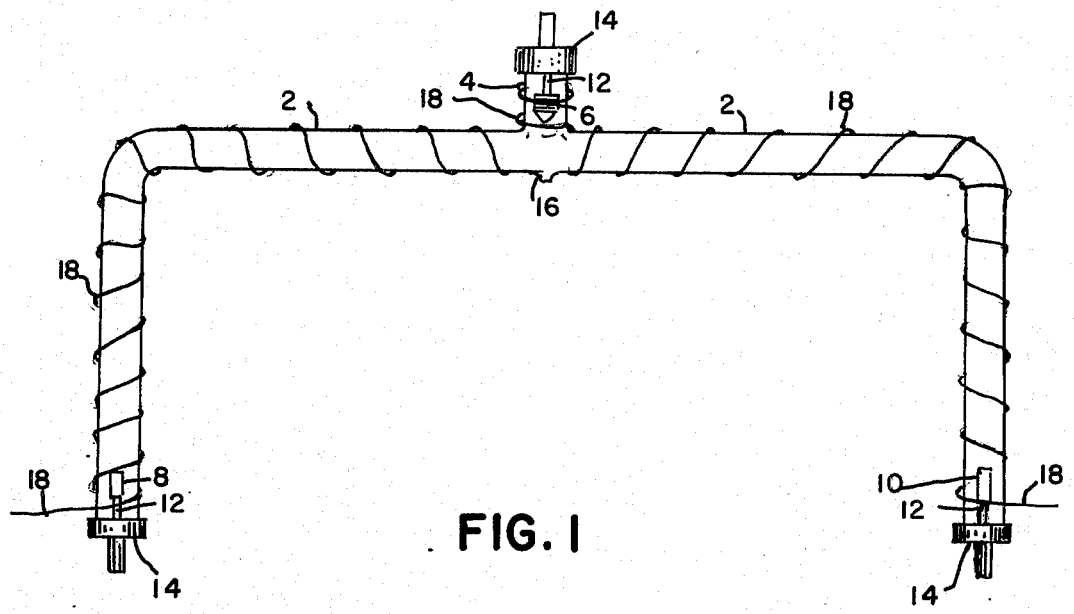
FIG. 1 illustrates a shunt-triggered three-electrode flash tube having an envelope of elongated glass tubing formed in a semi-rectangular configuration in accordance with the invention.

Referring to FIG. 1, the flash tube comprises an hermetically sealed, light-transmitting envelope 2 formed of an elongated piece of hard glass tubing (e.g., Corning No. 7740 glass) having a semi-rectangular (U-shaped) configuration. The envelope further includes a centrally located glass chamber 4 offset from the elongated tubular portion 2. A cathode electrode 6 is disposed within chamber 4, and a pair of anode electrodes 8 and 10 are disposed at opposite ends of the U-shaped envelope. Each electrode is attached to a respective lead-in wire 12 which is sealed through the glass envelope and electrically connected to a respective end cap 14 secured to the end of the chamber or tubing 2 by an adhesive. The envelope 2 is filled with a rare gas, such as xenon, at a subatmospheric pressure (e.g. 600 Torr) and is constricted to define an exhaust tip 16.

Anodes 8 and 10 may each comprise a rolled tantalum foil, while cathode 6 may comprise a pressed and sintered pellet of powdered tantalum and barium aluminate with a 100 percent pitched tungsten coil wound about the cylindrical sidewall of the pellet, such as described in copending application Ser. No. 412,811, filed Nov. 5, 1973 and assigned to the present assignee. Preferably, the cathode electrode extends toward the periphery of the elongated tubular portion 2 but does not project into the tube, which is the primary arc discharge path.

The flash tube electrodes are energized via the end caps 14 and lead-in wires 12, and a shunt (or external) trigger pulse is applied by means of an external trigger wire 18 wrapped about the exterior of the tubular-semirectangular envelope 2 and chamber 4 so as to properly ionize the arc discharge paths.

With the cathode 6 disposed between the anode electrodes 8 and 10, the cathode is common to both anodes during operation of the flash tube. Hence, upon shunt triggering the flash tube of FIG. 1 by the application of a voltage pulse to trigger wire 18, two separate arc discharge paths are simultaneously defined through respective portions of the envelope between the common cathode and respective anodes. That is, one arc discharge path will occur through the left hand section of the tubing between anode 8 and cathode 6, while the other discharge path between will follow the right hand section of the tubing between anode 10 and cathode 6. To assure a balanced light output and flash duration through both sections of tubing upon shunt triggering the lamps, the two discharge paths should have substantially equal impedances. Hence, the glass tubing is formed to have a substantially uniform internal diameter throughout, and the two discharge paths are dimensioned to have substantially equal lengths, such as by centrally locating the offset chamber 4 on the semi-rectangular configuration of glass tubing. In this manner, the triggering pulse will divide equally and ionize both discharge paths.

As the cathode 6 is recessed in chamber 4, flashing of the FIG. 1 lamp by ionization of the two discharge paths between the common cathode and two anode electrodes will provide the desired uniform illumination without a dark space therebetween. More importantly, however, the lamp of FIG. 1 uniquely solves the problem of a shorter flash duration requirement by replacing two L-shaped flash tubes with a single three-electrode lamp. For example, consider a given photocopying system having a flash duration requirement of 20 microseconds. If each of two shunt-triggered, parallel-connected L-shaped lamps has a 20 microsecond pulse duration, the system timing will likely have a longer duration as each lamp has a different ionization potential (ignition point) due to the fact that the cathodes have different activity levels. Flash duration is a function of the amount of energy dissipated in a lamp of a particular design. Over and above this, the duration of a system depends upon simultaneously ionizing all lamps, which is a function of the individual ionization points. Therefore, by reducing the number of cathodes from two to one, a single ignition point is provided for both discharge paths, and both sides of the semi-rectangle result in almost identical durations, depending upon whether or not the cathode is centered. If the lamps are shunt triggered, as described, the impedance paths do not have to be equal to assure triggering. However, to provide a balanced light output and flash duration, the impedance of one side of the lamp should be approximately the same as that of the other side.

According to one specific implementation of a shunt-triggered flash tube according to the invention, the glass tubing forming the semi-rectangular portion 2 has an internal diameter of about 8 millimeters and an outside diameter of about 10 millimeters; the same size glass tubing is also employed to form chamber 4. Each short side of the U-shaped glass tubing has a length of about 7½ inches, and the long side of the tubing has a length of about 20 inches from center line to center line, with the cathode being centrally located thereon; hence, each discharge path, from anode to common cathode is approximately 16 inches long. The electrodes 8 and 10 are rolled tantalum anodes and electrode 6 is a sintered cathode pellet of powdered tantalum and barium aluminate, with an overwind to prevent sputtering. The lamp is filled with xenon at 600 Torr pressure. The operating voltage range is from 3500 to 4500 volts DC; this is also referred to as the anode or supply voltage. To ignite the flash tube, a minimum peak trigger pulse of about 18,000 volts DC (open circuit), is applied to the external trigger wire 18 with the trigger primary supply voltage being about 800 volts DC. The resulting flash duration is in the other of 20 microseconds when the lamp is employed in a 100 watt-second system comprised of a pair of these three-electrode lamps connected in parallel.

Figure 2:
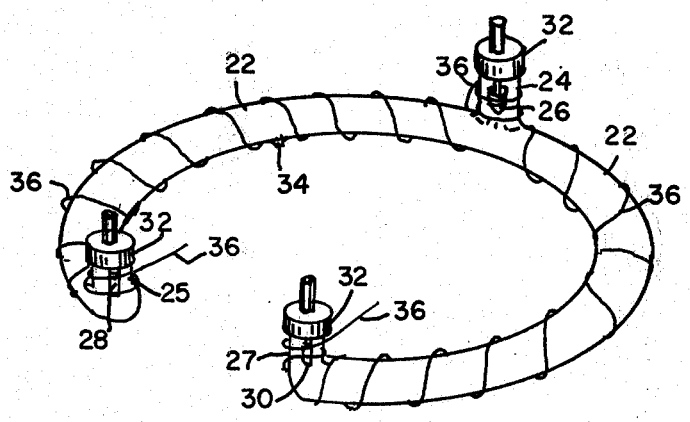
FIG. 2 is a perspective view of a shunt-triggered, three-electrode flash tube having an envelope of elongated glass tubing formed in an unclosed circular configuration in accordance with the invention.

FIG. 2 illustrates another embodiment of the invention in the form of a shunt-triggered circular-shaped lamp. The flash tube of FIG. 2 comprises an hermetically sealed light-transmitting envelope 22 formed of a hard glass tubing (e.g., Corning No. 7740 glass) having an unclosed circular configuration. The envelope further includes a centrally located glass chamber 24 and a pair of end chambers 25 and 27 offset from the elongated tubular portion 22. A cathode electrode 26 is sealed within chamber 24, and a pair of anode electrodes 28 and 30 are sealed within the chambers 25 and 27, respectively, at opposite ends of the unclosed circular envelope 22. As in the case of the semi-rectangular lamp, each of the anodes may comprise a piece of rolled tantalum foil, while the cathode may comprise a sintered pellet with an overwind, each of the electrodes being connected through lead-in wires to end caps 32. The envelope is filled with a rare gas, such as xenon, at a subatmospheric pressure and is constricted to define an exhaust tip 34.

The flash tube electrodes are energized via the end caps 32 and lead-in conductors which are sealed through respective ends of the offset chambers 24, 25 and 27. The shunt (or external) trigger pulse is applied by means of an external trigger wire 36 wrapped about the exterior of the tubular-circular envelope 22 and the electrode-containing chambers so as to properly ionize the arc discharge paths between the common cathode and two anode electrodes during pulsed operation.

In the typical photographic and photocopying applications where a uniform source of illumination is desired from the circular tubing, the two discharge paths formed between the anodes and cathode 26 should have substantially equal impedances. Thus, the unclosed circular glass tubing 22 should have a substantially uniform internal diameter throughout, and the cathode 26 should be centrally located so as to provide two discharge paths of substantially equal length. That is, one discharge path will be defined from the anode 30 through the right side of the circular tubing to the cathode electrode 26, while a second discharge path will be defined between the anode 28 and cathode 26 through the left side of the circular tubing. In this manner, upon energization of the external trigger wire 36, which is wrapped about the exterior of the envelope over both of the discharge paths, the resulting burst of light through both halves of the tubing will be substantially equal, or uniform, throughout.

In contrast to an injection-triggered lamp, however, the discharge paths need not be equal in length or impedance to assure ionization. The external trigger wire will cause ionization regardless of the respective path lengths, the difference in operation being that the discharge path of lower impedance will provide a brighter peak light output than the discharge path of higher impedance.

According to one specific implementation of the shunt-triggered flash tube of FIG. 2, the glass tubing of the circular-shaped envelope 22 has an inside diameter of about 10 millimeters, an outside diameter of about 12 millimeters, and a circumference, less the unclosed portion, of approximately 8 inches, whereby each of the two arc discharge paths between anodes 28 and 30 and the common cathode 26 provide an arc gap of approximately 4 inches. Electrodes 28 and 30 each comprise a rolled tantalum anode, and the cathode 26 is a sintered pellet with an overwind. The lamp is filled with xenon at about 100 Torr pressure. The supply voltage ranges from 500 to 800 volts DC, and to ignite the flash tube, an 8,000 volt peak trigger pulse is applied to external trigger wire 36. The resulting flash duration is in the order of 0.8 milliseconds.

The principles of the invention are also applicable to much smaller flash sources. For example, a shunt-triggered flash tube of the type illustrated in FIG. 2 has also been embodied in an unclosed circular envelope having a circumference of about 2¼ inches, thereby forming a pair of discharge paths between the two electrodes which each have an arc gap of about 1⅛ inch and provide a flash duration of 150–200 microseconds.

Hence, although the invention has been described with respect to the specific embodiments, it will be appreciated that modifications and changes may be made by those skilled in the art without departing from the true spirit and scope of the invention. For example, the flash tubes of FIGS. 1 and 2 may be adapted for injection triggering, in which case the external trigger wire is eliminated. However, with injection triggering, the two discharge paths must have approximately equal impedances to assure ionization of both sections of tubing. Further, in the shunt-triggered flash tube, conductive film could be used as the trigger means in lieu of a wire wrapped about the envelope.

What is claimed is:

1. A flash tube comprising:

an elongated, light-transmitting tubular envelope which is hermetically sealed;

a rare gas in said envelope;

a pair of anode electrodes in said envelope, one disposed at each end thereof;

a cathode electrode disposed in said envelope between said anode electrodes, said cathode being common to both of said anodes to thereby provide two discharge paths; and means for providing external triggering of both of said discharge paths whereby two separate arc discharge paths are simultaneously defined through respective portions of said envelope between the common cathode and respective anodes during operation of said flash tube, whereby a shorter flash duration is provided for a flash tube envelope of given length.

2. A flash tube according to claim 1 wherein said two discharge paths have substantially equal impedances.

3. A flash tube according to claim 1 wherein said envelope further includes a chamber offset from the elongated tubular portion, with said cathode being disposed in said chamber.

4. A flash tube according to claim 1 wherein said elongated tubular envelope is formed in an unclosed circular configuration.

5. A flash tube according to claim 4 wherein said external trigger means is wrapped about the exterior of said envelope over both of said discharge paths.

6. A flash tube according to claim 5 wherein said elongated tubular envelope has a substantially uniform internal diameter throughout, and said two discharge paths are of substantially equal length.

7. A flash tube according to claim 1 wherein said rare gas is xenon.

8. A flash tube according to claim 1 wherein said elongated tubular envelope is formed in a semi-rectangular configuration.

9. A flash tube according to claim 8 wherein said envelope further includes a chamber offset from the elongated tubular portion, with said cathode being disposed in said chamber.

10. A flash tube according to claim 9 wherein said two discharge paths have substantially equal impedances.

11. A flash tube according to claim 10 wherein said offset chamber is centrally located on said semi-rectangular envelope.

12. A flash tube according to claim 11 wherein said rare gas is xenon.

13. A flash tube according to claim 8 wherein said external trigger means is wrapped about the exterior of said envelope over both of said discharge paths.

14. A flash tube according to claim 4 wherein said envelope further includes a centrally located chamber offset from the elongated tubular portion and containing said cathode, and a pair of end chambers offset from the elongated tubular portion at opposite ends thereof and each containing a respective one of said anode electrodes.

15. Apparatus comprising, in combination:

a flash tube having an elongated, light-transmitting tubular envelope which is hermetically sealed;

a rare gas in said envelope;

a pair of anode electrodes in said envelope, one disposed at each end thereof; and a cathode electrode disposed in said envelope between said anode electrodes, said cathode being common to both of said anodes;

a supply voltage means connected for simultaneously energizing both of said anodes and said common cathode; and means coupled to said flash tube for applying a high voltage trigger pulse to ignite said flash tube, whereby two separate arc discharge paths are simultaneously defined through respective portions of said envelope between the common cathode and respective anodes during operation of said flash tube, whereby a shorter flash duration is provided for a flash tube envelope of given length.

16. Apparatus according to claim 15 wherein said two discharge paths have substantially equal impedance.

17. Apparatus according to claim 16 wherein said elongated tubular envelope has a substantially uniform internal diameter throughout, and said two discharge paths are of substantially equal length.

* * * * *